United States Patent [19]

Asai

[11] Patent Number: 4,645,974

[45] Date of Patent: Feb. 24, 1987

[54] DISCHARGE TUBE LIGHTING SYSTEM FOR USE IN A VEHICLE

[75] Inventor: Toshiyasu Asai, Okazaki, Japan

[73] Assignee: Nippondenso Co., Ltd., Kariya, Japan

[21] Appl. No.: 639,431

[22] Filed: Aug. 10, 1984

[30] Foreign Application Priority Data

Sep. 27, 1983 [JP] Japan ..... 58-178813

[51] Int. Cl.[4] ..... H01J 7/44; H01J 17/34; H01J 19/78; H01J 29/96; H01K 1/62

[52] U.S. Cl. ..... 315/50; 307/10 LS; 313/595; 313/596; 315/112; 315/115; 315/116; 315/117; 315/77

[58] Field of Search ..... 315/112, 115, 116, 117, 315/50, 77, 76; 313/594, 595, 596, 601; 307/10 LS

[56] References Cited

U.S. PATENT DOCUMENTS

| | | | |
|---|---|---|---|
| 2,246,339 | 6/1941 | Beregh | 315/115 X |
| 2,581,959 | 1/1952 | Koehler | 315/116 |
| 2,598,567 | 5/1952 | Voreaux | 315/115 |
| 3,157,820 | 11/1964 | Funke et al. | 315/117 X |
| 3,248,533 | 4/1966 | Mathis | 315/116 |
| 3,309,565 | 3/1967 | Clark et al. | 315/117 |
| 3,714,492 | 1/1973 | Roche | 315/115 |
| 4,388,558 | 6/1983 | Mizuno et al. | 315/77 |

FOREIGN PATENT DOCUMENTS

| | | | |
|---|---|---|---|
| 0459605 | 9/1949 | Canada | 313/596 |
| 0122549 | 2/1959 | U.S.S.R. | 315/115 |

*Primary Examiner*—Saxfield Chatmon

*Attorney, Agent, or Firm*—Cushman, Darby & Cushman

[57] ABSTRACT

In a discharge tube lighting system for use in a vehicle, a heat generating element, which is made of metal material, is formed on an outer surface of a tube element of the discharge tube along the longitudinal direction of the tube element, and a temperature detecting element is provided on a surface of the heat generating element. The heat generating element is electrically driven to heat the discharge tube at a starting period of lighting the discharge tube when a temperature of the heat generating element detected by the temperature detecting element is lower than a predetermined temperature. The heat generating element is formed in a rectangular shape and conformally disposed on a portion of the tube. The heater element has first and second ends which are disposed with respect to the electrodes of the tube to cause an electric field to be provided between each electrode and the corresponding end of the heater element.

8 Claims, 3 Drawing Figures

DISCHARGE TUBE LIGHTING SYSTEM FOR USE IN A VEHICLE

BACKGROUND OF THE INVENTION

This invention relates to a system for lighting a discharge tube which is suitable for a room lamp or a source of light for a display system in a vehicle.

Usually, inactive gas such as mercury vapor gas, argon gas or the like, for instance, is enclosed in a discharge tube along the longitudinal direction thereof.

However, the response characteristic of the inactive gas at a starting period of lighting the discharge tube is deteriorated in proportion to the decrease in the surrounding temperature of the discharge tube, whereby the discharge tube does not light at all, or lights only partly. Therefore, there is a problem in applying the discharge tube to a vehicle because the surrounding temperature thereof changes very much in dependence on a running area or a running time.

SUMMARY OF THE INVENTION

It is therefore an object of this invention to provide a discharge tube lighting system for use in a vehicle, wherein a discharge tube can be lit certainly and with fast response regardless of the surrounding temperature.

It is a further object of this invention to provide a discharge tube lighting system for use in a vehicle, wherein a lighting response characteristic of the discharge tube at a starting period of lighting the discharge tube will be improved.

According to this invention, a heat generating element made of metal film is formed on an outer surface of a tube element of a discharge tube along the longitudinal direction of the tube element and is electrically driven to heat the discharge tube at a starting period of lighting. In this case, preferably a temperature detecting element for detecting temperature of the heat generating element is provided, and the heat generating element is electrically driven only when the temperature of the heat generating element is lower than a predetermined temperature.

DESCRIPTION OF THE PREFERRED EMBODIMENT

Figure 1:
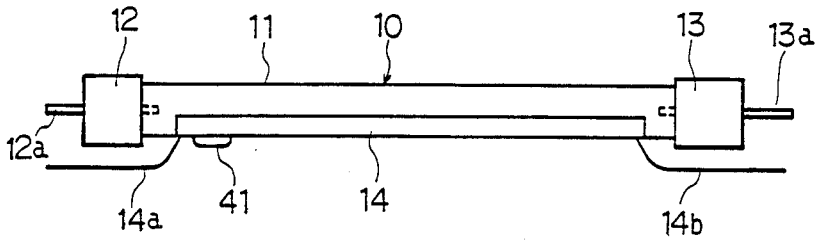
FIG. 1 is a front plan view of a cold cathode tube used in an embodiment of the present invention.

Referring to FIG. 1, a cold cathode tube 10 primarily comprises a tube element 11, support elements 12 and 13, electrode terminals 12*a* and 13*a*, a heat generating element 14, and a thermistor 41. The tube element 11 is made of a light transmitting material such as glass and a mercury vapor gas is enclosed therein. The support elements 12 and 13 are cup-shaped and are press-fitted to close open ends of the tube element 11, respectively. The electrode terminals 12*a* and 13*a* are respectively supported by the support elements 12 and 13 and extend outwardly therethrough from the inside of the tube element 11. When an a.c. electrical driving voltage is applied between the electrode terminals 12*a* and 13*a*, the cold cathode tube 10 emits light through the tube element 11 upon electrical discharge between the electrode terminals 12*a* and 13*a* in the mercury vapor gas.

The heat generating element 14 is formed by vapor-depositing a gold film uniformly to a transparent rectangular polyester film and is attached to an outer surface of the tube element 11 longitudinally to cover a part of the tube element 11. The heat generating element 14, particularly vapor-deposited gold, is made very thinly, and hence the light transmission through the heat generating element 14 is not disturbed substantially. The length and width of the heat generating element 14 may be determined to heat adequately the mercury vapor gas through the tube element 11 under a predetermined low temperature. Both ends of the heat generating element 14 are respectively spaced apart from inside ends of the support elements 12 and 13, or inner ends of the electrode terminals 12*a* and 13*a*, by about 10 mm and are respectively connected to electrode terminals 14*a* and 14*b*. The heat generating element 14 heats the tube element 11 by an electric current flowing between the electrode terminals 14*a* and 14*b* to which an electrical driving voltage is applied. On the other hand, the thermistor 41 is attached to a surface of the heat generating element 14 to detect a temperature thereof.

Figure 2:
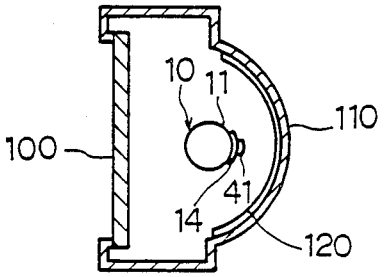
FIG. 2 is a sectional view of a display system having, as a source of light, the cold cathode tube shown in FIG. 1.

FIG. 2 is a sectional view of a display system in a vehicle having the cold cathode tube 10 as a source of light. The display system may be provided in an instrument panel of the vehicle. The cold cathode tube 10 is provided behind a conventional liquid crystal display device 100 which, as is known by those having skill in the field, includes a driving circuit (not shown). The liquid crystal display device 100 displays information concerning the operation of the vehicle. This information is displayed by the light shining through display 100 from tube 10. The liquid crystal display device 100 is supported by a case 110, and a reflecting mirror 120 is provided on an inner surface of the case 110 facing the device 100. Therefore, the direct light from the cold cathode tube 10 and the light reflected by the reflecting mirror 120 are transmitted through the liquid crystal display device 100 so that the display information may be displayed thereby. In this case, as the heat generating element 14 has light transmittivity, it does not substantially prevent light from the tube element 11 reaching the reflecting mirror 120. Therefore, the light from the tube element 11 is adequately reflected by the reflecting mirror 120.

Figure 3:
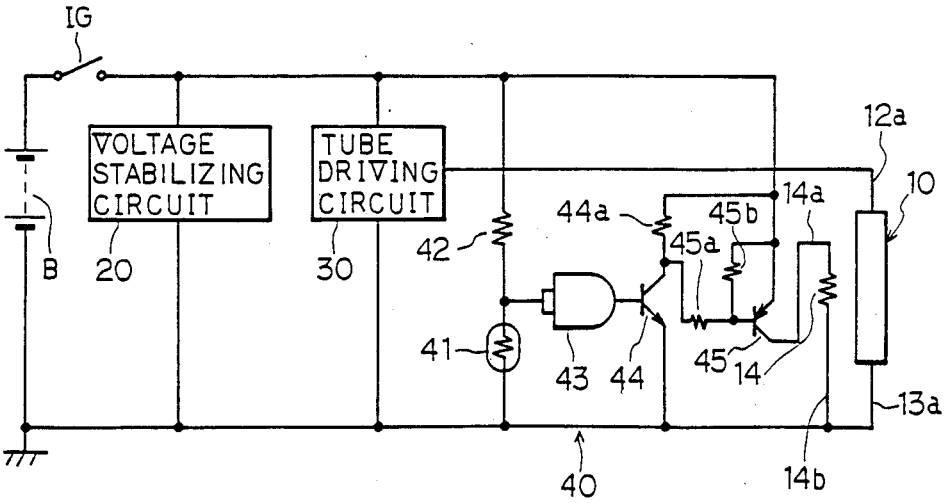
FIG. 3 is an electrical wiring diagram for electrically driving the cold cathode tube shown in FIG. 1.

The electrical wiring diagram of FIG. 3 shows a circuit arrangement which electrically drives the cold cathode tube 10. This circuit comprises a conventional voltage stabilizing circuit 20 connected to a d.c. battery B through an ignition switch IG, a tube driving circuit 30, and a heater driving circuit 40. The voltage stabilizing circuit 20 generates a stabilized d.c. voltage during closure of the ignition switch IG. The tube driving circuit 30, which arrangement is well known, generates an a.c. driving voltage in response to the stabilized voltage from the voltage stabilizing circuit 20 and applies the a.c. driving voltage between the electrode terminals 12*a* and 13*a*.

The heater driving circuit 40 includes the thermistor 41 connected in series with a resistor 42 and attached to the surface of the heat generating element 14 as described above. This thermistor 41 changes resistance in inverse proportion to a surrounding temperature and generates a temperature voltage by dividing the stabilized voltage from the voltage stabilizing circuit 20 by the proportion between the resistances of the thermistor 41 and a resistor 42. The temperature voltage is in inverse proportion to the surrounding temperature. A base of a transistor 44 is connected to a junction between the thermistor 41 and the resistor 42 through an AND gate 43. A collector of the transistor 44 is connected to the voltage stabilizing circuit 20 through a resistor 44*a*. Thus, the transistor 44 conducts by control of the AND gate 43 in response to the temperature voltage from the thermistor 41. The transistor 44 conducts when the detecting voltage is higher than a predetermined voltage, that is, when the surrounding temperature is lower than a predetermined temperature, whereas it does not conduct when the temperature voltage is lower than the predetermined voltage, that is, when the surrounding temperature is higher than the predetermined temperature.

A base of a transistor 45 is connected to the collector of the transistor 44 through a resistor 45*a*. An emitter of the transistor 45 is connected to the base of the transistor 45 through a resistor 45*b* and is connected to the voltage stabilizing circuit 20. A collector of the transistor 45 is connected to the heat generating element 14. Thus, the transistor 45 conducts in response to the conduction of the transistor 44 and generates a driving voltage from the collector thereof to apply the driving voltage to the heat generating element 14. On the other hand, the transistor 45 does not conduct in response to non-conduction of the transistor 44 and stops generating the driving voltage.

The operation of the embodiment will now be described. When the ignition switch IG is closed under the state that the surrounding temperature of the cold cathode tube 10 is lower than the predetermined temperature, the voltage stabilizing circuit 20 generates the stabilized voltage, and the tube driving circuit 30 generates the driving voltage to apply the driving voltage between the electrode terminals 12*a* and 13*a*. On the other hand, the thermistor 41 generates a comparatively high temperature voltage because of the low surrounding temperature, and the AND gate 43 generates a high level voltage. Thus, the transistor 44 conducts by receiving the high level voltage at the base thereof, and the transistor 45 conducts in response to the conduction of the transistor 44 to apply the driving voltage between the electrode terminals 14*a* and 14*b* of the heat generating element 14.

The cold cathode tube 10 begins to emit light through the tube element 11 owing to the electrical discharge between the electrode terminals 12*a* and 13*a* in the mercury vapor gas in response to the driving voltage from the tube driving circuit 30. In this case, as the heat generating element 14 heats the mercury vapor gas through the tube element 11 by the electric current between the electrode terminals 14*a* and 14*b* based upon the driving voltage from the heater driving circuit 40, the uniform and fast discharging in the cold cathode tube 10 is enabled so that the cold cathode tube 10 can be lit certainly and uniformly over the whole length in the tube element 11 with fast response.

On the contrary, when the surrounding temperature becomes higher than the predetermined temperature, the heater driving circuit 40 stops generating the driving voltage so that the heat generating element 14 stops heating the tube element 14.

It should be noted that, at a starting period of lighting the cold cathode tube 10, an electric field is generated between the heat generating element 14 and each of the electrode terminals 12*a* and 13*a* owing to the electric conductivity of the heat generating element 14, or the vapor-deposited gold, provided between the electrode terminals 12*a* and 13*a*, and impedance between the electrode terminals 12*a* and 13*a* decreases as if small impedance exists between the electrode terminals 12*a* and 13*a*, whereby lighting the cold cathodes in tube 10 is enabled with a lower driving voltage from the tube driving circuit 30.

Although the invention has been described through specific terms, the described embodiment is not exclusive but various changes and modifications may be imparted thereto.

For instance, it is possible to effect the following modifications.

(1) Though the heat generating element 14 is formed by vapor-depositing the gold on the polyester film attached to the outer surface of the tube element 11, it is possible to provide the heat generating element 14 by etching a thin metal net on the outer surface of the tube element 11.

(2) Though the heat generating element 14 is electrically driven only when the thermistor 41 detects that the surrounding temperature is lower than the predetermined temperature, it is possible to electrically drive the heat generating element 14 during a predetermined period of time after the closure of the ignition switch IG irrespective of the surrounding temperature.

(3) Though the cold cathode tube 10 is used, it is possible to use a hot cathode tube, a fluorescent lamp, or the like.

What is claimed is:

1. A discharge tube lighting system for use in a vehicle comprising:

a battery having a grounded terminal;

a tube driving circuit connected to said battery for generating an A.C. voltage;

a tube element having a pair of electrodes at opposite ends thereof for receiving said A.C. voltage thereacross and enclosing inactive gas therein for emitting light when electrically driven by said A.C. voltage:

a heat generating element having a grounded terminal and being made of electrically conductive material and being provided longitudinally on an outer surface of said tube element, for heating said inactive gas, said heat generating element being shaped in a rectangular film form and spaced apart from said electrodes of said tube element so that electric fields are provided between the heat generating element and said electrodes; and a heater driving circuit connected to said battery for generating a D.C. voltage, and for electrically driving said heat generating element by said D.C. voltage to heat said inactive gas at a starting period of electrically driving said tube element.

2. A discharge tube lighting system according to claim 1, further comprising:

a temperature detecting element for detecting a surrounding temperature of said inactive gas; and wherein said heater driving circuit drives said heat generating element only when the temperature of said inactive gas detected by said temperature detecting element is lower than a predetermined temperature.

3. A discharge tube lighting system according to claim 2, wherein said temperature detecting element is provided on a surface of said heat generating element.

4. Discharge tube lighting apparatus, comprising:

a cylindrical tube having first and second ends with first and second electrodes respectively disposed therein, said tube enclosing an inactive gas for emitting light when charged;

heater means, formed in a rectangular shape and conformally disposed on a portion of said tube, for (a) heating said inactive gas, and (b) generating electric fields between ends of said heater element and said first and second electrodes, respectively, when said tube electrodes are energized;

first driver means for driving said tube electrodes; and second driver means for driving said heater means.

5. Apparatus according to claim 4 wherein said heater element includes a heating element which is translucent.

6. Apparatus according to claim 5 wherein said heating element includes a rectangular polyester film with a vapor-deposited electrically conductive material disposed uniformly thereon.

7. Apparatus according to claim 4 wherein said first driver means includes a tube driving circuit for providing A.C. voltage to the tube electrodes, and wherein said second driver means includes a heater driving circuit for providing D.C voltage to said heater element.

8. Apparatus a-cording to claim 7 further including thermistor means, coupled to said heater element, for driving said heater driving circuit when a temperature of said heater element falls below a predetermined temperature.

* * * * *